US005156757A

United States Patent [19]

Migdal et al.

[11] Patent Number: 5,156,757

[45] Date of Patent: Oct. 20, 1992

[54] ACYLATED MANNICH THIOALKYLPHENOL MONO AND/OR BIS-SUCCINIMIDE LUBRICATING OIL ADDITIVES

[75] Inventors: Cyril A. Migdal, Croton-On-Hudson; Carl K. Esche, Wappingers Falls, both of N.Y.

[73] Assignee: Texaco Inc., White Plains, N.Y.

[21] Appl. No.: 636,474

[22] Filed: Dec. 31, 1990

[51] Int. Cl.[5] ..... C10M 105/72

[52] U.S. Cl. ..... 252/47.5; 252/47; 252/46.4

[58] Field of Search ..... 252/47.5

[56] References Cited

U.S. PATENT DOCUMENTS

| | | | |
|---|---|---|---|
| 3,442,808 | 5/1969 | Traise | 252/51.5 A |
| 3,493,520 | 2/1970 | Verdol | 252/51.5 A |
| 3,980,569 | 9/1976 | Pindar | 252/51.5 R |
| 4,440,655 | 4/1984 | Gemmill | 252/47.5 |
| 4,699,724 | 10/1987 | Nalesnik | 252/51.5 A |

*Primary Examiner*—Prince Willis, Jr.
*Assistant Examiner*—Thomas Steinberg
*Attorney, Agent, or Firm*—Robert A. Kulason; James J. O'Loughlin; Vincent A. Mallare

[57] ABSTRACT

A lubricating oil composition having improved dispersancy. The dispersant being prepared by coupling two mono- and/or bis-alkenyl succinimides with an aldehyde and thioalkylphenol. The resulting coupled succinimide is then an acylated with an acylating agent to form an acylated Mannich thioalkylphenol coupled mono and/or bis-alkenyl succinimide.

15 Claims, No Drawings

ACYLATED MANNICH THIOALKYLPHENOL MONO AND/OR BIS-SUCCINIMIDE LUBRICATING OIL ADDITIVES

BACKGROUND OF THE INVENTION

This invention is related to lubricating oil additives, and more particularly to acylated Mannich base-coupled mono and/or bis-succinimide multi-purpose lubricating oil additives.

It is well known that internal combustion engines operate under a wide range of temperatures including low temperature stop-and-go-service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkyl succinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

Thus, an object of the present invention is to provide a lubricating oil composition having improved dispersancy.

Another object is to provide a lubricating oil composition which can withstand the stresses imposed by modern internal combustion engines.

DISCLOSURE STATEMENT

U.S. Pat. Nos. 4,713,189 and 4,699,724 disclose a lubricating oil composition having improved dispersancy and Viton seal compatibility. The dispersant being prepared by coupling two mono-alkenyl succinimides with an aldehyde and a phenol. The resulting coupled succinimide is then acylated with glycolic acid to form a glycolate Mannich phenol coupled mono-alkenyl succinimide.

U.S. Pat. No. 4,636,322 discloses a lubricating oil composition having improved dispersancy and Viton seal compatibility. The dispersant being prepared by coupling partly glycolate succinimides with an aldehyde and a phenol.

U.S. Pat. Nos. 3,172,892 and 4,048,080 disclose alkenylsuccinimides formed from the reaction of an alkyne succinic anhydride and an alkylene polyamine and their use as dispersants in a lubricating oil composition.

U.S. Pat. No. 2,568,876 discloses reaction products prepared by reacting a monocarboxylic acid with a polyalkylene polyamine followed by a reaction of the intermediate product with an alkenyl succinic acid anhydride.

U.S. Pat. No. 3,216,936 discloses a process for preparing an aliphatic amine lubricant additive which involves reacting an alkylene amine, a polymer substituted succinic acid and an aliphatic monocarboxylic acid.

U.S. Pat. No. 3,131,150 discloses lubricating oil compositions containing dispersant-detergent mono- and dialkyl-succinimides or bis(alkenylsuccinimides).

Netherlands Patent 7,509,289 discloses the reaction product of an alkenyl succinic anhydride and an aminoalcohol, namely, a tris(hydroxymethyl) aminomethane.

U.S. Pat. No. 4,579,674 discloses a hydrocarbyl-substituted succinimide dispersant having a secondary hydroxy-substituted diamine or polyamine segment and a lubricating oil composition containing same.

U.S. Pat. No. 4,338,205 discloses alkenyl succinimide and borated alkenyl succinimide dispersants for a lubricating oil with impaired diesel dispersancy in which the dispersant is treated with an oil-soluble strong acid.

The disclosures of U.S. Pat. Nos. 3,172,892; 4,579,674; 4,636,322; 4,713,189; and 4,699,724; are incorporated herein by reference.

SUMMARY OF THE INVENTION

The present invention provides a novel additive which improves the dispersancy of a lubricating oil. The lubricating oil composition comprises a major portion of a lubricating oil and a minor dispersant amount of a reaction product (i.e., lubricant additive) which may be prepared as set forth below.

PROCESS

A process for preparing a lubricating oil additive comprising:

(a) reacting an amine with an alkenyl succinic acid anhydride to form a mono- and/or bis-alkenyl succinimide;

(b) adding a thioalkylphenol and an excess of formaldehyde to the mono- and/or bis-alkenyl succinimide to form a Mannich thioalkylphenol coupled mono- and/or bis-alkenyl succinimide;

(c) acylating the Mannich thioalkylphenol amine coupled mono- and/or bis-alkenyl succinimide with an acylating agent, thereby forming an acylated Mannich thioalkylphenol coupled mono-and/or bis-alkenyl succinimide; and (d) recovering the acylated Mannich thioalkylphenol coupled mono- and/or bis-alkenyl succinimide.

DETAILED DESCRIPTION

In carrying out the present process, the reactants are step wise reacted with a long chain hydrocarbyl substituted dicarboxylic acid anhydride containing residual unsaturation in a "one pot reaction". The long chain hydrocarbon group is a ($C_2$–$C_{10}$) polymer, e.g., a ($C_2$–$C_5$) monoolefin, the polymer having a number average molecular weight (Mn) of about 500 to about 10,000.

Preferred olefin polymers for reaction with the unsaturated dicarboxylic acid anhydride or ester are polymers comprising a major molar amount of a ($C_2$–$C_{10}$) polymer, e.g., a ($C_2$–$C_5$) monoolefin. Such olefins include ethylene, propylene, butylene, isobutylene, pentane, 1-octane, styrene, etc. The polymers can be homopolymers such as polyisobutylene, as well as copolymers of two or more of such olefins such as copolymers of: ethylene and propylene, butylene and isobutylene, propylene and isobutylene, etc. Other copolymers include those in which a minor molar amount of the copolymer monomers e.g., 1 to 10 mole% is a ($C_4$–$C_{10}$) non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight. In this case the alpha- or beta-unsaturated dicarboxylic acid anhydride is reacted with the saturated ethylene-propylene copolymer utilizing a radical initiator. The long chain hydrocarbyl substituted dicarboxylic acid producing material, e.g., acid or anhydride used in the invention includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumarate-chloromaleic anhydride, and mixtures thereof.

The alkenyl succinic acid anhydride is characterized by the following formula

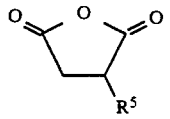

wherein the backbone polymer, $R^5$, is a polyolefin residue which was reacted with maleic acid anhydride to form the alkenyl succinic anhydride, and $R^5$ has a number average molecular weight (Mn) ranging from about 500–10,000, preferably from about 1000–5000, and more preferably from about 2000–2500.

The polyamine compositions which may be employed in practicing the present invention may include primary and/or secondary amines. The amines may typically be characterized by the formula

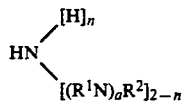

In this formula, a may be an integer of about 3 to about 8 preferably about 5 and may be 0 or 1; and n is 0 or 1. In the above compound, $R^2$ may be hydrogen or a hydrocarbon group selected from the group consisting of alkyl, aralkyl, cycloalkyl, aryl, alkaryl, alkenyl, and alkynyl, including such radicals when inertly substituted. The preferred $R^2$ groups may be hydrogen or a lower alkyl group, i.e. $C_1$–$C_{10}$ alkyl, groups including, e.g., methyl, ethyl, n-propyl, ipropyl, butyls, amyls, hexyls, octyls, decyls, etc. $R^2$ may preferably be hydrogen. $R^1$ may be a hydrocarbon selected from the same group as $R^2$ subject to the fact that $R^1$ is divalent and contains one less hydrogen. Preferably $R_2$ is hydrogen and $R^1$ is —$CH^2CH^2$—.

Typical amines which may be employed may include those listed below in Table 1.

TABLE 1

| |
|---|
| diethylenetriamine (DETA) |
| triethylenetetramine (TETA) |
| tetraethylenepentamine (TEPA) |
| pentaethylenehexamine (PEHA) |

The aldehyde which may be employed may include those preferably which are characterized by the formula $R^3CHO$. In the preceding compound, $R^3$ may be hydrogen or a hydrocarbon group consisting of alkyl, aralkyl, cycloalkyl, aryl, alkyaryl, alkenyl, and alkynyl including such radicals when inertly substituted i.e. it may bear a non-reactive substituent such as alkyl, aryl, cycloalkyl, ether, halogen, nitro, etc. Typically inertly substituted $R^3$ groups may include 3-chloropropyl, 2-ethoxyethyl, carboethoxymethyl, 4-methyl cyclohexyl, p-chlorophenyl, p-chlorobenzyl, 3-chloro-5-methylphenyl, etc. The preferred $R^3$ groups may be lower alkyl, i.e. $C_1$–$C_{10}$ alkyl, groups including methyl, ethyl, n-propyl, isopropyl, butyls, amyls, hexyls, octyls, decyls, etc. $R^3$ may preferably be hydrogen.

Typical aldehydes which may be employed may include those listed below in Table 2.

TABLE 2

| |
|---|
| formaldehyde |
| ethanol |
| propanal |
| butanal etc. |

The phenols which may be employed in practice of the process of this invention may preferably be characterized by the following formulas:

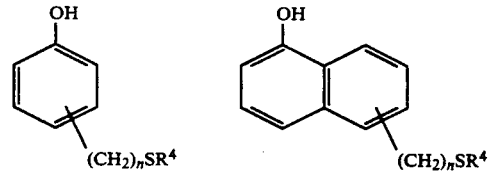

It is a feature of these phenols that they contain an active hydrogen which will be a site for substitution. Polyphenols (e.g. compounds containing more than one hydroxy group in the molecule whether on the same ring or not) may be employed. The rings on which the hydroxy groups are situated may bear substituents. In particular they may be substituted with alkylthioethers (i.e., $R^4S$—$(CH_2)_m$—, where m is 0 or 1 and $R^4$ is an alkyl group either branched, linear or cyclic or a combination thereof containing 1 to 50 carbons). However, at least two positions e.g., ortho- and para-, to a phenol hydroxy group, must be occupied by an active hydrogen as this is the point of reaction with the iminium salt group. The preferred phenols may be 2-[(octylthio)methyl]phenol, 4-[(octylthio)-methyl]phenol, and 2-methythiophenol.

The secondary amine groups of the polyalkenylamine moiety in the coupled mono- and/or bis-alkenyl succinimide are reacted with an acylating agent.

The acylating agent may be a carboxylic acid such as a hyroxyaliphatic acid or a fatty acid. The suitable fatty acids are straight chain compounds, ranging from 3 to 18 carbons. They may be saturated or unsaturated. Saturated acids include lauric, myristic, pentadecanoic, palmitic, margaric and stearic. Unsaturated acids include myristoleic, palmitoleic, oleic, linoleic and linolenic.

The hydroxyaliphatic acid preferably used as an acylating agent is a carboxylic acid characterized by the formula HO—$R^7$—COOH, wherein $R^7$ is an alkyl group having from 1 to about 4 carbon atoms and the hydroxyl group can be located at any available position therein.

The preferred acylating agents are glycolic acid, oxalic acids, lactic acid, 2-hydroxymethylpropionic acid, and 2,2-bis(hydroxymethyl) propionic acid, the most preferred being glycolic acid.

It is understood that equivalents of the carboxylic acids prescribed, namely their anhydrides, esters and acyl halides, can also be employed in the practice of this invention. A characteristic of the preferred $C_2$ and $C_3$ hydroxyaliphatic carboxylic acids is their relatively limited or negligible solubility in mineral oil.

The lubricating oil of the invention will contain the novel reaction product in a concentration ranging from about 0.1 to 30 weight percent. A concentration range for the additive ranging from about 0.5 to 15 weight percent based on the total weight of the oil composition is preferred with a still more preferred concentration range being from about 1 to 8.0 weight percent.

Oil concentrates of the additives may contain from about 1 to 75 weight percent of the additive reaction product in a carrier or diluent oil of lubricating oil viscosity.

The novel reaction product of the invention may be employed in lubricant compositions together with conventional lubricant additives. Such additives may include additional dispersants, detergents, antioxidants, pour point depressants, anti-wear agents and the like.

The novel additive reaction product of the invention was tested for its effectiveness as a dispersant in a fully formulated lubricating oil composition.

According to the present invention, the Mannich thioalkylphenol coupled mono- and/or bis-alkenyl succinimide may instead of being acylated, be borated with a borating agent, as described above, to form a borated Mannich thioalkylphenol coupled mono- and/or bis-alkenyl succinimide.

The borating agent, e.g., boron containing compound, is selected from the group consisting of boric acid, boron oxide, boron halide, and a boron acid ester, to provide a borated derivative thereof. The preferred borating agent being boric acid.

The above process and products are illustrated in the Examples below and by reviewing such Examples the present invention and its advantages will be more apparent.

EXAMPLE I

Preparation Of Ortho- And/Or Para-(Octylthio)Methyl]Phenol

Phenol (94.0 g, 1.0 moles), water (50.0 g, 2.78 moles), and a 40% solution of diethylamine (112.5 g, 1.0 moles) were charged to a one liter flask. The flask was equipped with a mechanical stirrer, condenser, thermometer, thermocouple, and an addition funnel. With the mixture at room temperature a 37% solution of formaldehyde (81.8 g, 1.0 moles) was added dropwise. During the formaldehyde addition the reaction flask was maintained at room temperature with use of an ice bath. The reaction mixture was stirred for two hours at room temperature and then 1-octanethiol (146 g, 1.0 moles) was added followed immediately by sodium hydroxide (44.0 g, 1.1 moles). The reaction mixture was stirred another 10 minutes at room temperature. Next the reaction mixture was heated to 100° C. and maintained at that temperature for 20 hours. Next ammonium chloride (59.0 g, 1.1 moles) was added to the cooled solution with stirring. The mixture was filtered through diatomaceous earth filter aid, followed by water removal in a separator funnel. Unreacted 1-octanethiol was removed under vacuum at 20 mm Hg and 125° C. The product analyzed as follows: %N=0.09 (0.0 calc.), %S=11.8 (12.6 calc.).

EXAMPLE II

Preparation Of Acylated Mannich Thioctylphenol Coupled Mono- And/Or Bis-Alkenyl Succinimide Dispersant A solution of polyisobutenylsuccinic acid anhydride (3965.0 g, 1.0 moles, PIBSA prepared from an approximately 2060 mol. wt. polybutene) in diluent oil (2370.2 g) was charged into a twelve liter 3-neck flask equipped with a mechanical stirrer, thermometer, thermocouple, and nitrogen inlet and heated to 60° C. Next pentaethylenehexamine (145.2 g, 0.55 moles) was added and the heat was increased to 120° C. and maintained for 2.0 hours. Then monothiooctylphenol (72.9 g, 0.27 moles) was added, followed by a 37% solution of formaldehyde (87.6 g, 1.08 moles). The temperature was maintained at 120° C. for 0.5 hours. Next a 70% solution of glycolic acid (159.8 g, 1.48 moles) was added and the temperature was raised to 160° C. and then maintained for 4 hours to drive off water. The hot mixture (~100° C.) was filtered through diatomaceous earth filter aid. The product (an approximately 40% active concentrate) analyzed as follows: % N=0.88 (0.80 calc.), Total Acid Number (TAN)=2.9, and Total Base Number (TBN)=10.1.

EXAMPLE III

Preparation Of Acylated Mannich Phenol Coupled Mono- And/Or Bis-Alkenyl Succinimide Dispersant (Comparative Example)

Same as example 2 except nonylphenol substituted for monothiooctylphenol. The product (an approximately 40% active concentrate) analyzed as follows: % N=0.82 ( 0.71 calc.).

EXAMPLE IV

Preparation of Acylated Mannich 2-Methythiophenol Coupled Mono and/or Bis-Alkenyl Succinimide Dispersant A solution of polyisobutenylsuccinic acid anhydride (1586.0 g, 0.592 moles, PIBSA prepared from an approximately 2060 mol. wt polybutene) in diluent oil (571.8g) was charged into a twelve liter 3-neck flask equipped with a mechanical stirrer, thermometer, thermocouple, and nitrogen inlet and heated to 60° C. Next pentaethylenehexamine (58.2g, 0.220 moles) was added and the heat was increased to 120° C. and maintained for 2.0 hours. Then 0-methythiophenol (15.1 g, 0.108 moles) was added, followed by a 37% solution of formaldehyde (358.0 g, 0.432 moles). The temperature was maintained at 120° C. for 0.5 hours. Next, a 70% solution of glycolic acid (63.9 g, 0.592 moles) was added and the temperature was raised to 160° C. and then maintained for 4 hours to drive off water. The hot mixture (~100° C.) was filtered through diatomaceous earth filter aid. The product (an approximately 40% active concentrate) analyzed as follows: % N=0.89 (0.85 calc.) and Total Base Number (TBN)=10.0.

EXAMPLE V

Sequence VE Gasoline Engine Test Results

The ASTM Sequence VE gasoline engine test is used to evaluate the performance of gasoline engine oils in protecting engine parts from sludge and varnish deposits and valve train wear due to low temperature "stop and go" operation. The test uses a Ford 2.3 L four-cylinder Ranger truck engine. The engine is cycled through three test stages, requiring four hours to complete, for 288 hours or 72 cycles. The Sequence VE gasoline engine test results shown below in Table 3 were run in a single fully formulated motor oil.

TABLE 3

| | Sequence VE Gasoline Engine Test Results | | | | | | | |
|---|---|---|---|---|---|---|---|---|
| Dispersant | AS[1] | AV | RACS | PSV | % ORC | % OSC | $CLW_{avg}$ | $CLW_{max}$ |
| Example[2] II | 9.2 | 5.2 | 8.1 | 7.0 | 0.0 | 0.0 | 0.6 | 0.9 |
| Example[2] III | 8.4 | 4.4 | 7.4 | 6.9 | 25.0 | 0.0 | 4.0 | 11.2 |
| Example IV | 9.3 | 5.0 | 7.4 | 7.2 | 0.0 | 0.0 | 1.9 | 5.1 |
| Limits | $9.0_{min}$ | $5.0_{min}$ | $7.0_{min}$ | $6.5_{min}$ | $15.0_{max}$ | $20.0_{max}$ | $5_{max}$ | $15_{max}$ |

[1]AS, AV, RACS, PSV, ORC, OSC, $CLW_{avg}$, and $CLW_{max}$ denote: average sludge, average varnish, rocker arm cover sludge, piston skirt varnish, oil ring clogging, oil screen clogging, cam lobe wear average, and cam lobe wear maximum, respectively.
[2]SAE 30 fully formulated motor oil

EXAMPLE VI

Bench Sludge Test

This test is conducted by heating the test oil mixed with synthetic hydrocarbon blowby and a diluent oil at a fixed temperature for a fixed time period. After heating, the turbidity of the resulting mixture is measured. A low percentage trubidity (20–40) is indicative of good dispersancy while a high value (40 to 200) is indicative of an oil's increasingly poor dispersancy. The results obtained with the known and present dispersants are set forth below in Table 4 below at 6.5% percent by weight concentration, in a SAE 30 W fully formulated motor oil.

TABLE 4

| Bench Sludge Test Results | |
|---|---|
| Dispersant | Rating |
| Example II | 32 |
| Example III (Comparative) | 57 |
| Reference (SG) | 36 |
| Reference (good) | 32 |
| Reference (fair) | 65 |
| Referencfe (poor) | 105 |

We claim:

1. A lubricating oil composition comprising a major portio of a lubricating oil and a minor amount of reaction product prepared the process comprising:

(a) reacting an amine with an alkenyl succinic acid anhydride at a temperature of 60° to 120° C. for a period of 2.0 hours to form a mono- and/or bis-alkenyl succinimide;

(b) adding a thioalkylphenol and an excess of formaldehyde to said mono- and/or bis-alkenyl succinimide at about 120° for 0.5 hours to form a Mannich thioalkylphenol coupled mono- and/or bis-alkenyl succinimide;

(c) acylating said Mannich thioalkylphenol coupled mono- and/or bis-alkenyl succinimide with an acylating agent, at a temperature of about 120° C. to about 160° C. for about 4.0 hours, thereby forming an acylated Mannich thioalkylphenol coupled mono- and/or bis-alkenyl succinimide; and (d) recovering said acylated Mannich thioalkylphenol coupled mono- and/or bis-alkenyl succinimide.

2. The lubricating oil composition of claim 1, wherein said acylating agent is selected from the group consisting of glycolic acid, oxalic acid, lactic acid, 2-hydroxymethylpropionic acid and 2,2-bis (hydroxymethyl) propionic acid.

3. The lubricating oil composition of to claim 2, wherein said acylating agent is glycolic acid.

4. The lubricating oil composition of claim 1, wherein said Mannich thioalkylphenol coupled mono- and/or bis-alkenyl succinimide is instead borated with a borating agent to form a borated Mannich thioalkylphenol coupled bis-alkenyl succinimide.

5. The lubricating oil composition of claim 4, wherein said borating agent is selected from the group consisting of boric acid, a boron acid ester, boron oxide and a boron halide.

6. The lubricating oil composition of claim 5, wherein said borating agent is boric acid.

7. The lubricating oil composition of claim 1, wherein said acylating is carried out at about 150° C. to about 175° C.

8. The lubricating oil composition of claim 1, wherein said amine is represented by the formula

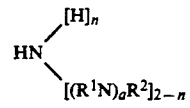

where $R^1$ is hydrogen or a hydrocarbon selected from the group consisting of alkyl, aralkyl, cycloalkyl, aryl, alkaryl. alkenyl and alkynyl group; $R^2$ is a hydrocarbon selected from the same group as $R^1$ except that $R^2$ contains one less H; a is an integer of about 3 to about 8; and n is 0 or 1.

9. The lubricating oil composition of claim 1, wherein said amine is selected from the group consisting of diethylene-triamine, triethylenetetramine, tetraethylenepentamine and pentaethylenehexamine.

10. The lubricating oil composition of claim 9, wherein said amine is tetraethylenepentamine.

11. The lubricating oil composition of claim 9, wherein said amine is pentaethylenehexamine.

12. The lubricating oil composition of claim 9, wherein said amine is triethylenetetramine.

13. The lubricating oil composition of claim 1, wherein said alkenyl succinic acid anhydride has a number average molecular weight of about 500 to about 10,000.

14. A lubricating oil composition comprising a major portion of a lubricating oil and a minor amount of reaction product prepared the process comprising:

(a) reacting an amine with an alkenyl succinic acid anhydride at a temperature of 60° C. to 120° C. for a period of 2.0 hours to form a mono- and/or bis-alkenyl succinimide;

(b) adding a thioalkylphenol and an excess of formaldehyde to said mono- and/or bis-alkenyl succinimide at about 120° for 0.5 hours to form a Mannich thioalkylphenol coupled mono- and/or bis-alkenyl succinimide; said thioalkylphenol is represented by the formulas

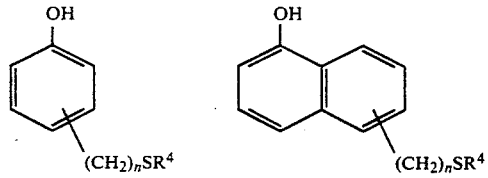

where $R^4$ is a branched, linear or cyclic ($C_1$–$C_{50}$) alkyl group; and n is 0 or 1;

(c) acylating said Mannich thioalkylphenol coupled mono- and/or bis-alkenyl succinimide with an acylating agent, at a temperature of about 120° C. to about 160° C. for about 4.0 hours, thereby forming an acylated Mannich thioalkylphenol coupled mono- and/or bis-alkenyl succinimide; and (d) recovering said acylated Mannich thioalkylphenol coupled mono- and/or bis-alkenyl succinimide.

15. The lubricating oil composition of claim 14, wherein said thioalkylphenol is ortho-[(octylthio)-methyl] phenol, para-phenol or 2-methyl thiophenol.

* * * * *